US006648767B1

(12) United States Patent
Chen

(10) Patent No.: US 6,648,767 B1
(45) Date of Patent: Nov. 18, 2003

(54) INFLATABLE WATER SLIDE

(75) Inventor: Samuel Chen, Hong Kong (CN)

(73) Assignee: Sports Power, Ltd.

( * ) Notice: Subject to any disclaimer, the term of this patent is extended or adjusted under 35 U.S.C. 154(b) by 0 days.

(21) Appl. No.: 10/347,769

(22) Filed: Jan. 20, 2003

(51) Int. Cl.[7] ..... A63G 21/18
(52) U.S. Cl. ..... 472/117; 472/134
(58) Field of Search ..... 472/116, 117, 472/134, 128; 104/69, 70; 4/488, 494; 446/220, 225, 226

(56) References Cited

U.S. PATENT DOCUMENTS 3,032,343 A * 5/1962 Freeberg ..... 472/116
5,772,535 A * 6/1998 Murphy ..... 473/415
6,039,327 A * 3/2000 Spector ..... 280/87.021
6,062,983 A * 5/2000 Butsook ..... 472/117
6,406,377 B1 * 6/2002 Demko ..... 472/117
6,558,264 B2 * 5/2003 Gordon ..... 472/117

* cited by examiner

*Primary Examiner*—Kien T. Nguyen
(74) *Attorney, Agent, or Firm*—Clement Cheng

(57) ABSTRACT

An inflatable water slide has an inflatable main section of an inflatable ramp section, formed as an inflatable channel for receiving users and inflatable retaining sidewall members formed on the left and right side of the inflatable channel, and an inflatable ladder section, having rope ladder rungs. Also, one pair of inflatable stabilizing chamber members attached to each opposite left and right side of the inflatable main section. The pair of stabilizing chamber members are a separately inflatable and deflatable. The inflatable stabilizing chambers stabilize the inflatable main section, and an attachment for a water hose, the attachment holding a water hose to allow a flow of water from the water hose to begin at an apex of the inflatable main section and end at a bottom end of the ramp section.

19 Claims, 2 Drawing Sheets

INFLATABLE WATER SLIDE

Figure 1:
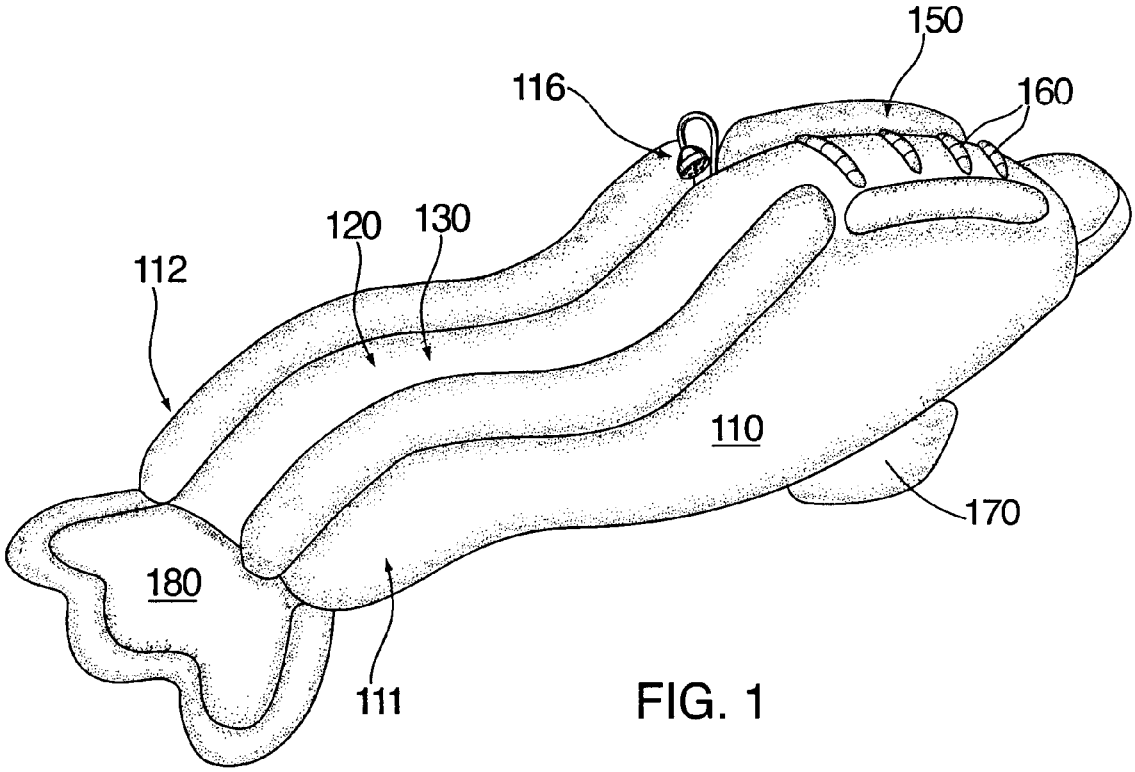
Figure 2:
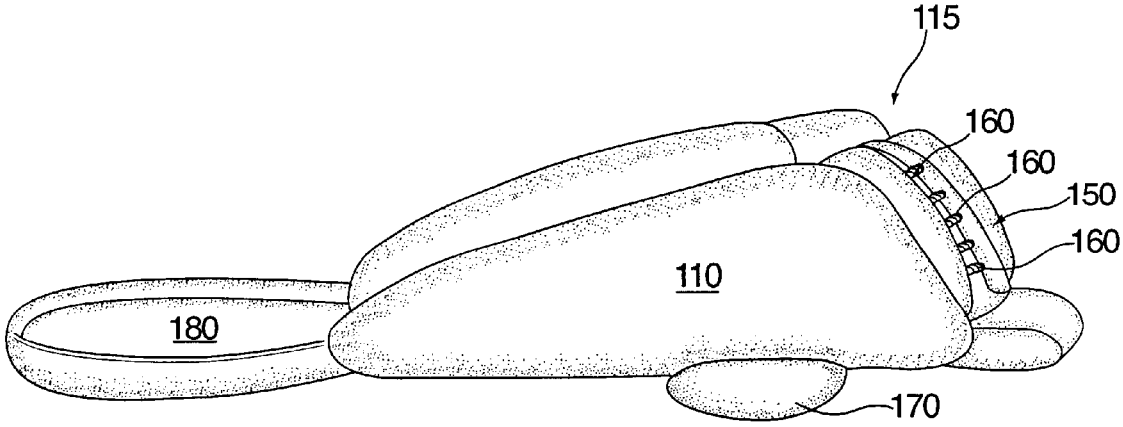

The present invention is an inflatable water slide comprising: an inflatable main section 110 forming a ramp section 120 and a ladder section 150. The ladder section 150 allows a user to climb to the apex 115 where the ramp section 120 begins. A user rider may then slide down the ramp section 120 in a seated position. An inflatable pool 180 holding water may be attached to the bottom end of the ramp section 120 to receive the user rider and water running through the center channel of the ramp section 120.

The inflatable main section 110 has a left 111 and right side 112. The left side 111 is defined as the left side of the slide from the perspective of a user rider climbing the ladder and riding the slide in a seated position. The right side 112 is defined as the right side of the slide from the perspective of a user rider climbing the ladder and riding the slide in a seated position. A user climbs a rope ladder at the ladder section 150 and can slide down the slide. The rope ladder 150 is comprised of a series of rungs 160 made of rope. Rope is attached at opposite ends of the ladder section 150 to form the rungs 160. The rope ladder rungs 160 have slack to allow even distribution of weight on the ladder section 150. Each rung 160 may be made of a plurality of ropes.

The ramp section 120 forms a channel 130 where a quantity of water flows freely down the slide from an upper slide portion to a lower slide portion. The inflatable water slide includes a water hose attachment 118 to decrease friction between the user and the surface of the channel 130. A water hose 118 is attached to the upper slide portion providing a flow of water downstream to a lower slide portion. The lower slide portion terminates in a pool of water 180. A water hose 118 is attached to the apex of the inflatable water slide. The water hose attachment 118 optionally includes a spraying nozzle for distributing water evenly across the top of the channel 130. The lower pool 180 optionally includes a recirculating pump for pumping water through a water hose 118 back to the apex of the slide.

For variation, the slide may have a curved profile that snakes left to right or may have differing degrees of slope. The slope of the ramp section 120 may vary. The ramp 120 preferably creates an acute angle with the ground, less than 45 degrees to provide a longer ramp section 120.

Inflatable retaining sidewalls 140 are formed in on each side of the channel 130. Inflatable retaining sidewalls 140 keep user riders from falling off of the slide. Retaining sidewalls 140 additionally keep water within the channel ramp portion of the slide, and the water keeps people moving through the middle portion of the slide.

A stabilizing chamber 170 is placed on either side of the slide. The stabilizing chamber 170 is attached to the inflatable main section 110. The stabilizing chamber 170 is a separate chamber and may be inflated or deflated depending to suit the ground that the slide is positioned upon. Additionally, the stabilizing chamber 170 may reach underneath the apex of the inflatable main section 115. The stabilizing chamber 170 protrudes from the bottom of the inflatable main section 110. Children who play at the apex 115 may fall off of the higher portion of the rope ladder may land on the stabilizing chamber 170. Thus, the stabilizing chamber 170 is a safety device for catching riders who fall off of the apex of the slide or the slide ramp.

The stabilizing chamber members 170 may be attached to the bottom of the main section 110 and the side of the main section 110. The stabilizing chamber members 170 may be attach ed to the side of the main section 110. The stabilizing chamber members 170 may be attached to the bottom of the main section 110. The best mode is when stabilizing chambers 170 are attached partially under the main section 110, and partially to the sides of the main section 110 so that when inflated, the main section 110 may be cradled and balanced. For example, when the monster slide is placed on slightly sloped ground, such that the slide is perpendicular to the slope of the ground a user would notice that the left side of the slide is lower than and the right side of the slide. Here, the main section 110 may be balanced by inflating the downhill left stabilizing chamber slightly more than the uphill right stabilizing chamber 170.

The main member is preferably one chamber, including the ladder portion 150 and the ramp slide portion 120. The sidewalls 140 are preferably one chamber, in fluid communication with the main chamber. However, the best mode is to have stabilizing chambers 170 independently sequestered from the main section 110. Alternatively, the stabilizing chambers 170 may have fluid communication and share air pressure with the main section 110. All inflatable members further include a valve for inflation and deflation of members.

The foregoing describes the preferred embodiments of the invention and modifications may be made without departing from the spirit and scope of the invention as set forth in the following claims.

What is claimed is:

1. An inflatable water slide comprising:

an inflatable main section comprising;

a ramp section, having retaining sidewalls, a ladder section, having rope ladder rungs, at least one pair of stabilizing chamber members attached to each opposite left and right side of the inflatable main section, the at least one pair of stabilizing chamber members are separately inflatable, wherein upon the inflation, a stabilizing chamber applies pressure to the side of the main section, where by the stabilizing chamber stabilize the main section, wherein inflation pressure may vary to provide varying support to the main sections, whereby a variance in pressure between opposing stabilizing chambers allows a user to stabilize the main section on the sloping ground.

2. The device of claim 1, wherein the ramp has varying degrees of slope.

3. The device of claim 1, wherein the ramp has less than 45 degrees of slope.

4. The device of claim 1, wherein the stabilizing chamber members are attached to the bottom of the main section and the side of the main section.

5. The device of claim 1, wherein the stabilizing chamber members are attached to the side of the main section.

6. The device of claim 1, wherein the stabilizing chamber members are attached to the bottom of the main section.

7. An inflatable water slide comprising:

an inflatable main section comprising;

an inflatable ramp section, formed as an inflatable channel for receiving users and inflatable retaining sidewall members formed on the left and right side of the inflatable channel, an inflatable ladder section, having rope ladder rungs, one pair of inflatable stabilizing chamber members attached to each opposite left and right side of the inflatable main section, the at least one pair of stabilizing chamber members having a separately inflatable and deflatable, wherein upon the inflation, a stabilizing chamber applies pressure to the side of the main section, whereby the inflatable stabilizing chamber stabilizes the inflatable main section, wherein inflation pressure may vary to provide varying support to the main sections; an attachment for a water hose, the attachment holding a water hose to allow a flow of water from the water hose to begin at an apex of the inflatable main section and end at a bottom end of the ramp section.

8. The inflatable water slide of claim 7, further comprising: an inflatable pool attached to the bottom end of the ramp section, wherein the inflatable pool holds water that flows from the ramp section, and receives users at the bottom of the ramp section.

9. The device of claim 8, wherein the stabilizing chamber members are attached to the bottom of the main section and the side of the main section.

10. The device of claim 8, wherein the stabilizing chamber members are attached to the side of the main section.

11. The device of claim 8, wherein the stabilizing chamber members are attached to the bottom of the main section.

12. The device of claim 8, wherein the inflatable main section is a single chamber in fluid communication with the ramp section, the retraining sidewalls and the ladder section; wherein the stabilizing chambers are fluid communication with each other and reach to communicate with each other under the main section.

13. The device of claim 8, wherein the inflatable main section is a single chamber in fluid communication with the ramp section, the retraining sidewalls and the ladder section; wherein the stabilizing chambers are independently isolated and not in communication with the main section and may be independently inflated or deflated.

14. A method of stabilizing an inflatable water slide comprising the steps of:

attaching an inflatable stabilizing chamber to the left side of a main section of a slide, attaching an inflatable stabilizing chamber to the right side of a main section of a slide, the inflatable stabilizing chambers independently sequestered from the main section of the slide.

15. The method of claim 14 additionally comprising the step of: attaching a second pair of inflatable stabilizing chambers to the left and right sides of a main section of a slide, the second pair of inflatable stabilizing chambers positioned between the apex of the slide and the end of the slide where a user exits the slide.

16. The method of claim 14 wherein the step of attaching an inflatable stabilizing chamber to the left side of a main section of a slide, and the step of attaching an inflatable stabilizing chamber to the right side or a main section of a slide include inflatable stabilizing chambers that reach from the apex of the slide to the end of the slide where a user exits the slide, wherein the inflatable stabilizing chambers parallel and are attached to the left and right side of the main section of the slide, whereby the inflatable stabilizing chambers may be independently inflated or deflated to suit the ground upon which the slide is positioned.

17. The method of claim 16, wherein the stabilizing chamber members are attached to the bottom of the main section and the side of the main section.

18. The method of claim 16, wherein the stabilizing chamber members are attached to the side of the main section.

19. The method of claim 16, wherein the stabilizing chamber members are attached to the bottom of the main section.

* * * * *